US008641262B2

(12) United States Patent
Mollhagen

(10) Patent No.: US 8,641,262 B2
(45) Date of Patent: Feb. 4, 2014

(54) BUILDING MATERIAL MIXER

(75) Inventor: Klaus-Peter Mollhagen, Memmingen (DE)

(73) Assignee: Liebherr-Components Biberach GmbH, Biberach/Riss (DE)

( * ) Notice: Subject to any disclaimer, the term of this patent is extended or adjusted under 35 U.S.C. 154(b) by 1395 days.

(21) Appl. No.: 12/148,325

(22) Filed: Apr. 18, 2008

(65) Prior Publication Data

US 2008/0291772 A1 Nov. 27, 2008

(30) Foreign Application Priority Data

Apr. 20, 2007 (DE) ..... 10 2007 018 776

(51) Int. Cl.
*B28C 5/18* (2006.01)

(52) U.S. Cl.
USPC ..... 366/63; 366/53; 366/54; 366/55; 366/62

(58) Field of Classification Search
USPC ..... 366/54, 55, 62, 63, 53
See application file for complete search history.

(56) References Cited

U.S. PATENT DOCUMENTS

| | | | | |
|---|---|---|---|---|
| 4,335,963 | A * | 6/1982 | Jameson et al. | 366/63 |
| 4,575,254 | A | 3/1986 | Johnston | |
| 5,348,387 | A | 9/1994 | Gordon et al. | |
| 2008/0273416 | A1 * | 11/2008 | Heilig | 366/62 |

FOREIGN PATENT DOCUMENTS

| | | |
|---|---|---|
| DE | 19 30 753 | 1/1966 |
| DE | 2248844 | 8/1973 |
| DE | 2341250 | 2/1975 |
| DE | 3121797 | 12/1982 |
| DE | 20 2004 020370 | 5/2005 |
| DE | 102004038504 | 2/2006 |
| DE | 102005027038 | 12/2006 |
| DE | 102005012823 | 9/2008 |
| WO | 2006/015835 | 2/2006 |
| WO | 2006/131335 | 12/2006 |
| WO | WO2006131335 | * 12/2006 |

* cited by examiner

*Primary Examiner* — Yogendra Gupta
*Assistant Examiner* — Robert J Grun
(74) *Attorney, Agent, or Firm* — Dilworth & Barrese, LLP.

(57) ABSTRACT

The present invention relates to a building material mixer having a mixer drum which can be rotationally driven by a mixer drive, with the mixer drum being rotatably supported by the mixer drive at a mixer frame part, in particular a traveling gear frame part, at one of its end face ends and with the mixer drive having a drive part, in particular a hydraulic motor, and a drive transmission connected to the mixer drum. In accordance with the invention, the building material mixer is characterized in that the mixer drive is movably supported by movable bearing means at the mixer frame part allowing tilting movements; and in that the mixer drum is fastened to the transmission housing of the drive transmission.

14 Claims, 4 Drawing Sheets

BUILDING MATERIAL MIXER

BACKGROUND OF THE INVENTION

The present invention relates to a building material mixer having a mixer drum which can be rotationally driven by a mixer drive, with the mixer drum being rotatably supported by the mixer drive at a mixer frame part, in particular a traveling gear frame part, at one of its end face ends and with the mixer drive having a drive part in particular a hydraulic motor, and a drive transmission connected to the mixer drum.

With building material mixers in the form of truck mixers, which are usually used for the supply of premixed concrete to construction sites, large dynamic forces frequently act on the mixer drum, for example when driving over bumpy approach roads so that the frequently heavily loaded mixer drums cause considerable dynamic bearing forces. On the other hand, twists of the traveling gear frame on which the mixer drum is supported arise when driving on uneven ground so that alignment errors of the bearing points result or the bearing point at the frame side twists with respect to the bearing point at the drum side. These twists and dynamic bearing stresses are particularly problematic on the side of the mixer drum which is supported by the mixer drive since such twists or dynamic bearing forces cannot easily be introduced into the transmission of the mixer drive. To be able to compensate or allow the named twists and alignment errors as a result of frame twists, the connection between the mixer drive and the mixer drum is conventionally made in a yielding manner in that a twist-capable connection part is used for the mixer drum fastening. FIG. 3 shows a conventional mixer drive, more precisely its transmission, which is made as a two-stage planetary gear which is driven by a drive motor not shown in any more detail at the input side and drives a drum flange at the output side, said drum flange being shown at the right in FIG. 3 and being rigidly connected to the mixer drum. The transmission housing of the mixer transmission shown in FIG. 3 is rigidly screwed to a bearing block rigidly connected to the traveling gear. Twists of the traveling gear frame supporting the mixer drive with respect to the mixer drum or vice versa can be compensated up to a certain degree by the drum flange designed to be capable of twisting. As FIG. 3 shows, the said drum flange is directly shaped at the output shaft of the mixer transmission, but is made very thin so that it allows twists as a result of tilting movements. In addition, the bearing of the output shaft supporting the drum flange by obliquely positioned tapered roller bearings is made such that the twist stiffness is also kept very limited by it to permit compensation movements.

The permitting of the named twists and their compensation can, however, bring along fatigue problems. In addition, the vibration problems as a result of dynamic loads can only be solved in an unsatisfactory manner by the solutions known up to now. It would also be desirable to achieve compact solutions.

SUMMARY OF THE INVENTION

Starting from this, it is the underlying object of the invention to provide an improved building material mixer of the initially named kind which avoids disadvantages of the prior art and further develops the latter in an advantageous manner. In particular a better compensation of twists of the frame part supporting the mixer drive with respect to the mixer drum should be achieved with a compact, small bearing arrangement which simultaneously also intercepts the dynamic loads from the mixer drum.

This object is solved in accordance with the invention by a building material mixer in accordance with the description herein. Preferred embodiments of the invention are also the subject of the description herein.

It is therefore proposed no longer to intercept the twists between the mixer frame and the mixer drum or no longer to intercept them only at the interface between the mixer transmission and the mixer drum, but to fasten the total mixer drive movably to the mixer frame such that the total mixer drive also takes part in twist movements of the mixer drum with respect to the traveling gear frame or, vice versa, twist movements of the traveling gear frame are compensated at the interface between the mixer frame and the mixer drive. In accordance with the invention, the mixer drive is movably supported at the mixer frame part by movable bearing means allowing tilting movements. In this connection, the mixer drum is fastened to the transmission housing of the drive transmission, whereby a drum flange projecting beyond the drive transmission is saved and hereby the axial construction length of the arrangement can be shortened. In contrast to previous solutions, the output movement of the mixer transmission is no longer transmitted via a transmission shaft and a drum flange fastened thereto, but rather via the transmission housing of the mixer transmission to the mixer drum. The transmission housing is accordingly no longer rigidly fastened to the mixer frame part, but is rotatably supported thereat. Not only an arrangement with a shorter axial construction can be achieved in this manner, but also a better force flow with respect to the bearing forces induced by the mixer drum. The transmission shaft is no longer exposed to the known high bending forces: in addition, due to a moving together of the bearing point at the frame side and of the bearing point at the mixer drum side, a lower lever arm is produced which overall results in a lower twist strain on the mixer drive and in particular of the mixer transmission.

In a further development of the invention, the mixer drum is fastened to a drum bearing point of the transmission housing, said drum bearing point being set back from the end face of the drive transmission facing the mixer drum toward the drive part of the mixer drive such that the drive transmission projects from the named drum bearing point toward the mixer drum or into the mixer drum. The drum bearing point is therefore set back toward the drive motor, whereby the bearing forces introduced into the transmission housing at the drum bearing point have a low lever length with respect to the bearing point at the frame side and a favorable force flow can be achieved with respect to the bearing forces.

The transmission housing can in particular have a fastening flange projecting forward at the jacket surface side at which the mixer drum or a mixer drum connection member is rigidly fastened, is for example screwed tight by bolts. The named fastening flange can be placed onto the transmission housing in the manner of a tire, for example, and can be rigidly fastened there, for example welded on or screwed. In a further development of the invention, the fastening flange is preferably integrally shaped onto the transmission housing.

The bearing means on the frame side, by means of which the mixer drive is supported rotationally fixedly at the mixer frame with respect to the axis of rotation of the drive, but in a manner allowing tilting movements transversely thereto, advantageously engage at a bearing point of the mixer drive which is disposed in the region of the drive part, in particular of the hydraulic motor of the mixer drive. The named bearing point of the mixer drive at the frame side can preferably be disposed approximately centrally to the axial extent of a motor body of the mixer drive.

Accordingly, therefore, the bearing points of the mixer drive, namely the bearing point at the frame side, on the one hand, and the bearing point at the mixer drum side, on the other hand, are moved together such that overall favorable conditions result with respect to the force flow and to the dissipation of the bearing forces. In addition, a particularly compact construction is achieved which is characterized by low axial space requirements.

The aforesaid bearing means for the movable support of the mixer drive at the mixer frame allowing tilting movements are advantageously made as resilient and movement-damping, in particular as elastic so that not only twists and alignment errors between the frame part and the mixer drum can be compensated, but also dynamic bearing forces can be intercepted in a favorable manner and unwanted vibrations can be reduced. In this connection, the bearing means in particular include an elastic bearing member by which the mixer drive is fastened to the mixer frame part.

In a further development of the invention, the at least one rubber bearing member is installed and/or designed such that the rubber bearing member does not undergo any tensile loads, but is always only stressed on pressure and/or shear. The rubber bearing member can in particular be installed at a sufficiently high bias which prevents the occurrence of tensile loads of the rubber bearing member.

The bearing member does not necessarily have to be a rubber bearing member; it can also be a plastic bearing member having corresponding properties or a bearing member made of another material which has the desired resilient and/or vibration-damping properties.

The bearing means for the movable support of the mixer drive at the frame permitting tilting movements can generally be designed differently with respect to their structures. In accordance with an advantageous embodiment of the invention, a bearing ring can be provided in which a preferably cylindrical and/or annular inner bearing part is seated such that the inner bearing part is held rotationally fixedly toward the bearing ring with respect to the axis of rotation of the drive, but can move with respect to the bearing ring, and indeed in particular in the form of tilting movements around a tilting axis extending transversely to the axis of rotation of the mixer drive and/or of the mixer drum, with the movability advantageously being designed such that tilting movements are possible around a plurality of tilting axes which are disposed in a plane perpendicular to the axis of rotation of the mixer drum.

In a further development of the invention, at least one resilient bearing member, preferably a rubber bearing member, is provided between the named bearing ring and the inner bearing part seated therein and the bearing ring and the inner bearing part are held movably with respect to one another by said resilient bearing member. In a further development of the invention, a plurality of resilient bearing members can be layered onto one another between the bearing ring and the inner bearing part seated therein, with annular intermediate members being able to be provided between the individual bearing members.

The named bearing ring does not necessarily have to have the shape of a closed ring; a bearing ring in the form of a ring segment in the manner of a semi-annular or three-quarter annular bearing bed or a bearing fork can also be provided. Preferably, however, a fully circumferential bearing ring is provided in which the inner bearing part is seated enclosed over the full circumference. The inner bearing part is advantageously made somewhat cylindrical and in particular likewise in annular shape, with the outer jacket side of the inner bearing part being able to be arched like a ball.

In a further development of the invention, the bearing ring surrounds a housing part which surrounds the drive part of the mixer drive, in particular its hydraulic motor, and at which the aforesaid inner bearing part is provided. In this connection, the inner bearing part can be made as a separate component and can be rigidly fastened to the housing part. Alternatively, the inner bearing part can also be made integrally directly at the housing part.

The bearing ring surrounding the named housing part can be rigidly fastened to the mixer frame part, for example screwed by bolts.

The transmission housing supporting the mixer drum can generally have a different structure. In accordance with an advantageous embodiment of the invention, the transmission housing has a jacket surface part which is connected to the mixer drum and which is rotatably supported at a housing connection part which is supported by the aforesaid bearing means at the mixer frame. The housing connection member can advantageously surround the drive part of the mixer drive, in particular its motor body, and/or form a housing part for this drive part.

To enable a simple servicing of the motor of the mixer drive and a good accessibility thereto, the housing connection member surrounding the drive part can advantageously form a mounting chamber into which the drive part, in particular the engine of the mixer drive, can be placed at the end face in the manner of a separate module. Accordingly, the motor only has to be pushed axially onto the transmission, with it vice versa also being able to be dismantled in a simple manner. For this purpose, a coupling is preferably provided between the motor shaft and the transmission input shaft which can be closed and released by an axial movement.

To avoid excess stress on the moving bearing means for the support of the mixer drive by excessive twists, the movability of the mixer drive support is limited in an advantageous further development of the invention. For this purpose, an abutment can be provided which limits a tilting of the mixer drive with respect to the mixer frame. The abutment can generally be made in different manners in this connection. In accordance with an advantageous embodiment of the invention, the abutment can include an abutment part formed by the bearing ring as well as an abutment part formed by the transmission housing or connected thereto, said abutment parts moving apart on the reaching of a predetermined order of magnitude of the tilting movement.

In a further development of the invention, the movable support of the mixer drive at the mixer frame part has a movability in the form of a permitted angular offset of more than 2° and preferably less than 10°. The permitted angular offset can advantageously amount to between 4° and 8°, in particular approximately 6°, which enables a sufficient compensation of frame twists, on the one hand, and prevents vibration problems due to excessive movability, on the other hand.

BRIEF DESCRIPTION OF THE DRAWINGS

The invention will be explained in more detail in the following with respect to a preferred embodiment and to associated drawings. There are shown in the drawings.

DESCRIPTION OF THE PREFERRED EMBODIMENTS

Figure 1:
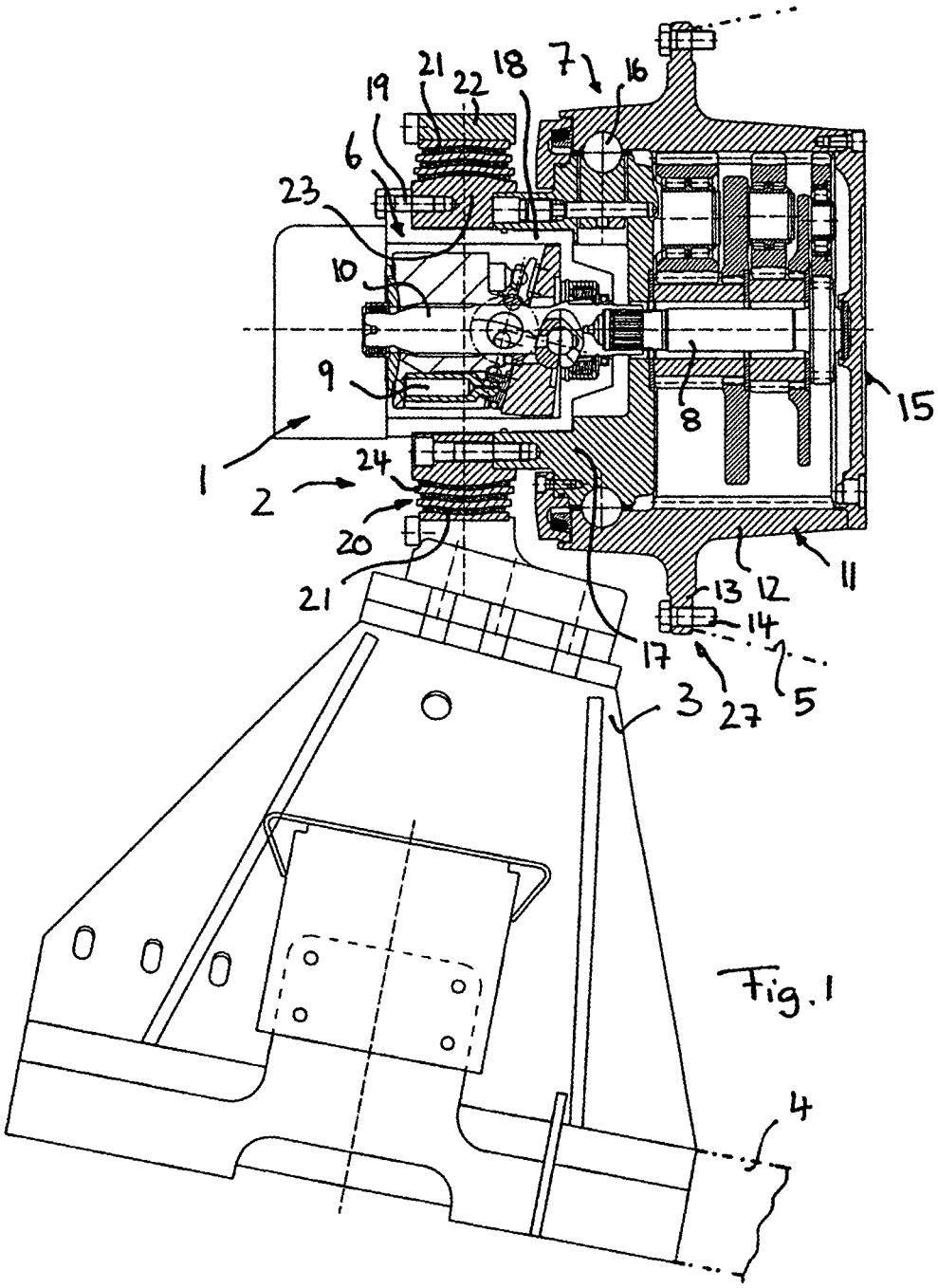
FIG. 1: a longitudinal section through the mixer drive of a truck mixer and its support on a frame block fastened to the traveling gear frame.
Figure 2:
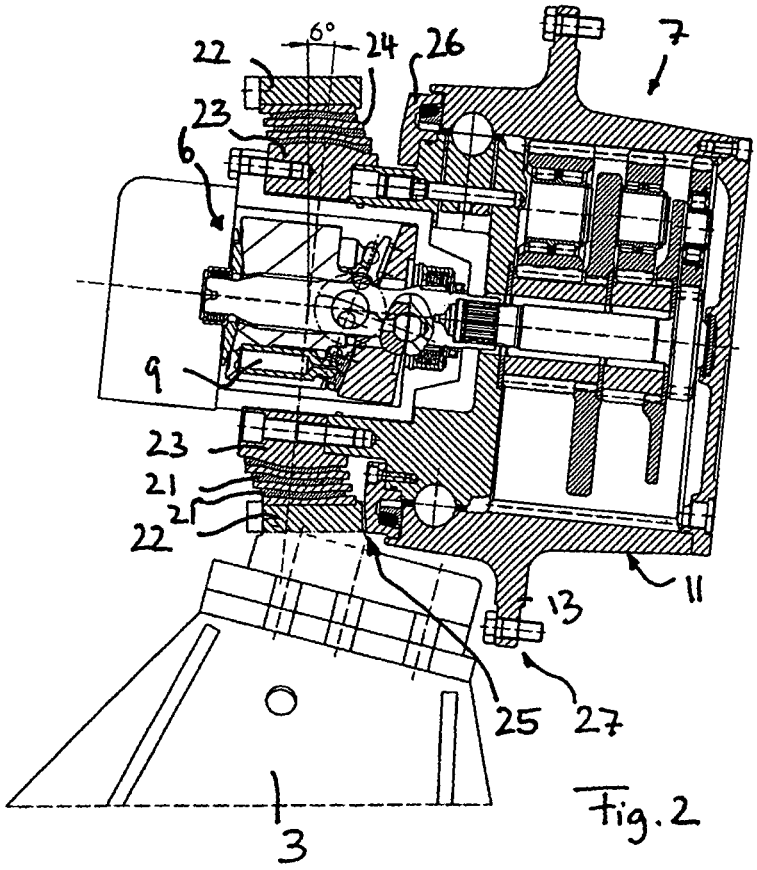
FIG. 2: a longitudinal section through the mixer drive and its support from FIG. 1, with the mixer drive being tilted with respect to the frame block supporting it by the movability of the support.
Figure 3:
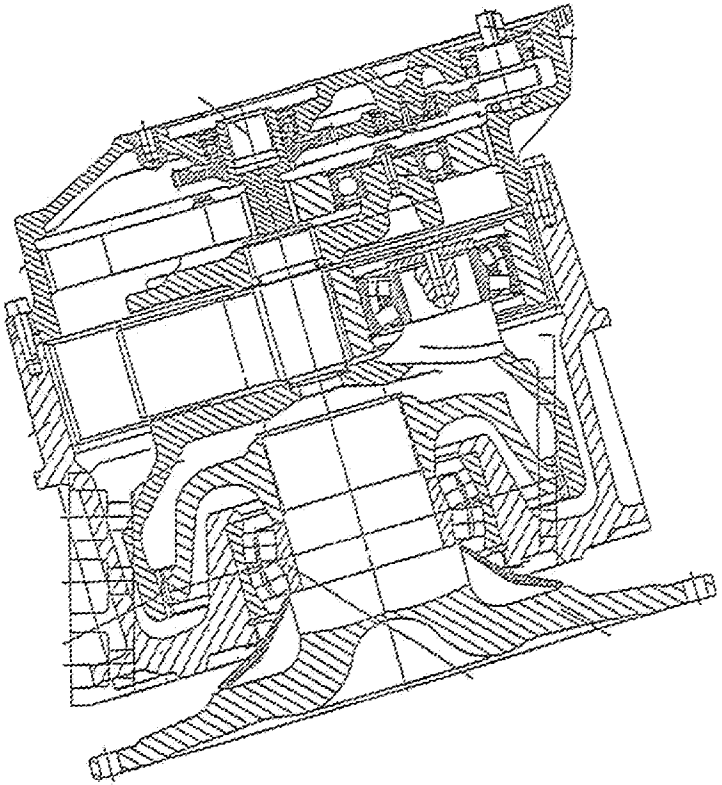
Fig. 3 PRIOR ART
FIG. 3: a longitudinal section through a conventional mixer drive in which the transmission housing is rigidly screwed to the bearing block and the mixer drum is fastened via a drum flange seated on a transmission output shaft.
Figure 4:
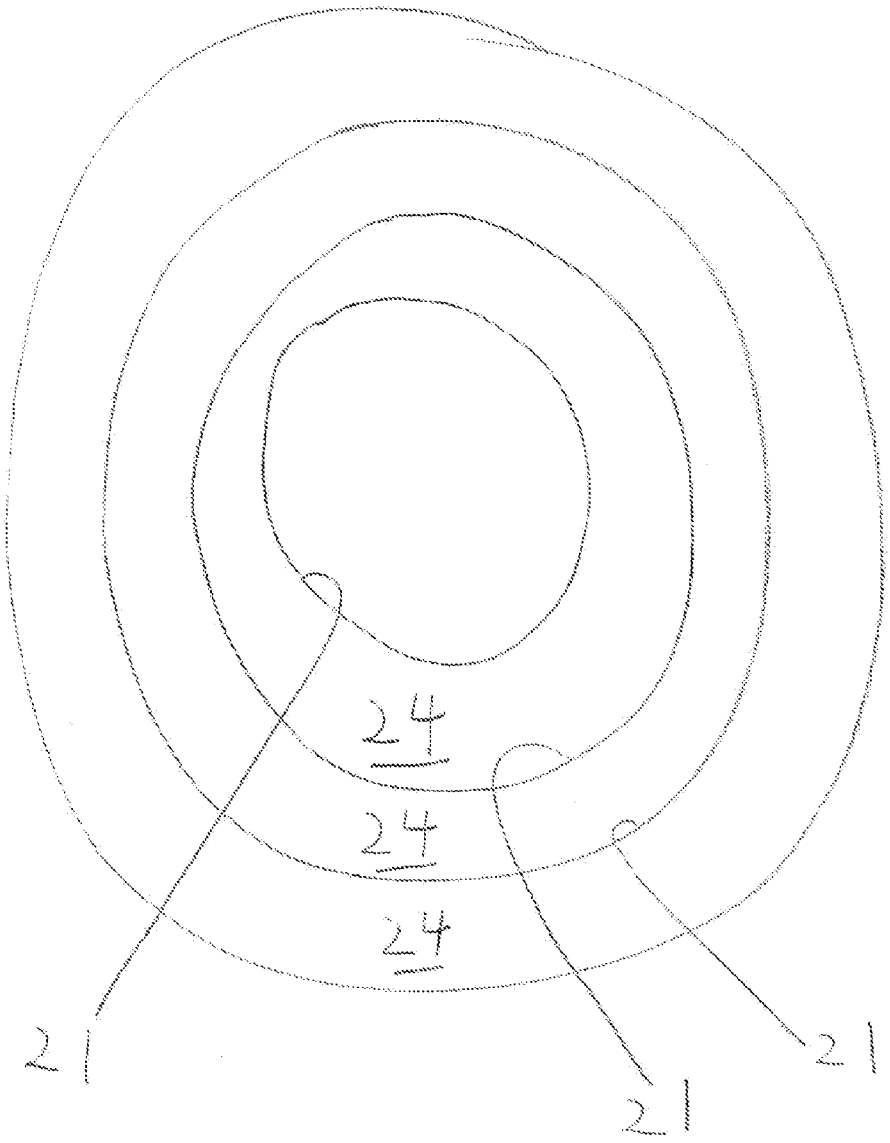
FIG. 4: a partial left end view of the mixing drive shown in FIGS. 1 and 2 and illustrating concentric arrangement of bearing members separated by intermediate rings.

The mixer drive 1 shown in FIGS. 1 and 2 is seated via a mixer support 2 on a bearing block 3 which is supported with the traveling gear frame 4 of a truck mixer not shown in another respect. In this connection, the truck mixer comprises in a manner known per se a multiaxial traveling gear having corresponding wheels which supports the named traveling gear frame 4 on which an operator's cabin is arranged in a manner likewise known per se, with the mixer drive and the mixer drum 5 driven by it being disposed behind said operator's cabin.

As FIG. 1 shows, the mixer drive 1 comprises a drive part 6 for the generation of a rotatory drive movement as well as a drive transmission 7 which is driven by the named drive part 6 at the input side and drives the mixer drum 5 rotationally at the output side. In the embodiment drawn, the drive transmission 7 is made as a two-stage planetary gear whose sun gear of the first stage is driven via the input shaft 8 by the drive part 6.

In the drawn embodiment, the drive part 6 comprises a hydraulic motor 9 in the form of a hydraulic axial piston engine whose drive shaft 10 can be rotationally fixedly coupled to the input shaft 8 of the drive housing 7. The drive part 6 is seated at the drive transmission 7 at the end face, cf. FIG. 1.

As FIG. 1 shows, the drive transmission 7 comprises a housing 11 which includes a jacket surface part 12 which surrounds the transmission stages of the planetary gear at the circumferential side. A radially projecting drum flange 13 is provided approximately centrally at the jacket surface part 12 and the mixer drum 5, which is only indicated in FIG. 1, can be rigidly fastened thereto by bolts 14. In this connection, the said drum flange 13 is set back from the end face 15 of the drive transmission 7 facing the mixer drum 5 toward the drive part 6, cf. FIG. 1, so that the drive transmission 7 or its transmission housing 11 projects toward the mixer drum 5.

The jacket surface part 12 of the transmission housing 11 is rotatably supported by a rolling bearing 16 at a housing connection part 17 which covers the drive transmission 7 at the end face, on the one hand, and bounds a mounting chamber 18, on the other hand, into which the hydraulic motor 9 of the drive part 6 is inserted at the end face, cf. FIG. 1. The hydraulic motor 9 can hereby be fixed easily at the drive transmission 7 in the manner of a separate module or can be inserted into the housing connection part 17 in that it is fastened by bolts 19.

The housing connection part 17 is supported rotationally fixedly with respect to the axis of rotation of the motor by the mixer support 2, but tiltably around tilting axes extending transversely thereto at the bearing block 3 of the traveling gear frame 4. The tiltability of the mixer drive 1 is given in all directions in the manner of a ball joint, i.e. the tiltability can take place around several tilting axes extending in a plane perpendicular to the drawing plane of FIG. 1. FIG. 2 shows a tilted position, with the maximum tilting angle of 6° being drawn.

The mixer support 2 in this connection comprises movably formed bearing means 20 which permit tilting movements transversely to the drive axis and which are made resilient and damping, in particular elastic.

In the drawn embodiment, the bearing means 20 advantageously comprise a plurality of resilient, deformable bearing members 21 which can in particular be made in the form of rubber bearing members by which the mixer drive 1 is fastened to the bearing block 3 connected to the traveling gear frame 4.

In this connection, the bearing means 20 advantageously include a bearing ring 22 in which an inner bearing part 23 is seated which is likewise made in annular form and which can be tilted with respect to the bearing ring 22. This is enabled by the resiliently deformable bearing members 21 which are seated between the bearing ring 22 and the inner bearing part 23, cf. FIG. 1. In this connection, the bearing members 21 can form ring shell segments, but are preferably made as bearing ring members and have a flattened elongate cross-section, cf. FIG. 1. In the drawn embodiment a plurality of annular resilient bearing members 21 are seated over one another or in one another, with the bearing members 21 being separated from one another by intermediate pieces 24 likewise of ring shape, cf. FIG. 1. In this connection, the resilient, in particular elastic, bearing members 21 are biased between the bearing ring 22 and the inner bearing part 23 such that they are only stressed on pressure or shear, but are not tensile stressed, even on deformations such as FIG. 2 shows. The bearing ring 22 and the inner bearing part 23 are movable toward one another, and are in particular tiltable, as FIG. 2 shows, due to the resilient bearing members 21 so that the bearing means 20 overall or the mixer support 2 has a movability which permits tilting movements of the mixer drive 1 around almost any desired tilting axes transversely to the drive axis.

The tiltability of the mixer drive 1 with respect to the bearing block 3 is limited in this respect by an abutment 25 which is formed, on the one hand, by an end face of the bearing ring 22 and, on the other hand, by a cover ring 26 which covers the bearing gap between the jacket surface part 12 of the transmission housing 11 and its housing connection part 17 and is fastened to the latter housing connection part 17.

The invention claimed is:

1. A building material mixer having a mixer drum (5) which can be rotationally driven by a mixer drive (1), with the mixer drum (5) being rotatably supported by the mixerdrive (1) at a mixer frame part (3, 4), in particular a traveling gear frame part (4), at one of its end face ends and with the mixer drive (1) having a drive part (6), in particular a hydraulic motor (9), and a drive transmission (7) connected to the mixer drum (5), wherein the mixer drive (1) is encompassed and movably supported by movable bearing means (20) at the mixer frame part (3, 4) allowing tilting movements, the mixer drum (5) is fastened to a transmission housing (11) of the drive transmission (7), the bearing means (20) have a plurality of ring-shaped elastic bearing members (21) of different diameters positioned, one within the other, in coaxial alignment about an axis of the mixer drive (1), by which the mixer drive (1) is fastened to the mixer frame part (3, 4), the elastic bearing members (21) are positioned such that they are always only stressed on pressure and/or shear and installed under a sufficiently strong bias which prevents the occurrence of tensile strains in the elastic bearing members (21), the bearing means (20) additionally have a bearing ring (22) in which a preferably cylindrical and/or annular inner bearing part (23) is/are seated and fastened to or formed with the mixer drive (1), with said elastic bearing members (21) being arranged between the bearing ring (22) and the inner bearing part (23), with the bearing ring (22) and the inner bearing part (23) being held movably with respect to one another by said elastic bearing members (21), the bearing ring (22) surrounds a housing part (17) which encompasses the drive part (6) of the mixer drive (1) and at which the inner bearing part (23) is fastened or formed, with the bearing ring (22) being rigidly fastened to the mixer frame part (3, 4), and said elastic bearing members (21) being tiltable in a direction parallel to the axis of the mixer drive (1).

2. A building material mixer in accordance with claim 1, wherein the mixer drum (5) is fastened to a drum bearing point (27) of the transmission housing (11) which is offset from the end face of the drive transmission (7) remote from the drive part (6) of the mixer drive (1) toward the named drive part (6) such that the drive transmission (7) projects from the drum bearing point (27) into the mixer drum (5) or toward the mixer drum (5).

3. A building material mixer in accordance with claim 1, wherein the transmission housing (11) has a preferably integrally shaped fastening flange (13) to which the mixer drum (5) is rigidly fastened.

4. A building material mixer in accordance with claim 1, wherein the transmission housing (11) has a jacket surface part (12) which is connected to the mixer drum (5) and which is rotatably supported at the housing connection part (17) which is supported at the mixer frame part (3, 4) by the bearing means (20).

5. A building material mixer in accordance with claim 4, wherein the housing connection part (17) of the transmission housing (11) surrounds the drive part (6) of the mixer drive (1) or forms this drive part (6).

6. A building material mixer in accordance with claim 4, wherein the housing connection part (17) of the transmission housing (11) forms a mounting chamber (18) into which the drive part (6), in particular its hydraulic motor (9), can be placed at the end face in the manner of a separate module.

7. A building material mixer in accordance with claim 1, wherein the at least one elastic bearing member (21) is rubber.

8. A building material mixer in accordance with claim 7, wherein the rubber bearing member (21) is installed under a sufficiently strong bias which prevents the occurrence of tensile strains of the rubber bearing member (21).

9. A building material mixer in accordance with claim 1, wherein a plurality of preferably annular resilient bearing members (21) are provided between the bearing ring (22) and the inner bearing part (23) and are arranged disposed radially in one another and/or separated from one another by intermediate pieces.

10. A building material mixer in accordance with claim 1, wherein an abutment (25) is provided for the limiting of the tilting of the mixer drive (1) with respect to the mixer frame part (3, 4).

11. A building material mixer in accordance with claim 4, wherein an abutment (25) is provided for the limiting of the tilting of the mixer drive (1) with respect to the mixer frame part (3, 4), and the abutment (25) has an abutment part formed by the bearing ring (22) as well as an abutment member formed by the transmission housing (11), in particular its housing connection part.

12. A building material mixer in accordance with claim 1, wherein the bearing means (20) have a limited tiltability with a maximum tilting angle starting from the neutral position of at least 2° and of a maximum of 15°, preferably of more than 4° and less than 8°, in particular of approximately 6°.

13. A building material mixer in accordance with claim 1, wherein said at least one elastic bearing member (21) is positioned and configured such that tilting movement of said bearing means (20) occur by deformation of said at least one elastic bearing member (21).

14. A building material mixer in accordance with claim 1, additionally comprising a roller bearing (16) rotatably supporting the transmission housing (11) on the housing connection part (17), separate and apart from the bearing means (20).

* * * * *